United States Patent [19]

Dewey

[11] 4,083,492

[45] Apr. 11, 1978

[54] APPARATUS AND METHOD FOR PREVENTING ICING ON A SNOW-MAKING MACHINE

[76] Inventor: Gordon C. Dewey, 157 E. 65th St., New York, N.Y. 10021

[21] Appl. No.: 731,046

[22] Filed: Oct. 8, 1976

[51] Int. Cl.[2] ..... F25C 3/04

[52] U.S. Cl. ..... 239/2.5; 239/14; 239/135

[58] Field of Search ..... 239/2 S, 14, 77, 129, 239/135

[56] References Cited

U.S. PATENT DOCUMENTS

| | | | |
|---|---|---|---|
| 2,315,096 | 3/1943 | Sanderson et al. | 239/129 X |
| 2,618,508 | 11/1952 | Daugherty | 239/77 |
| 2,886,249 | 5/1959 | Sidlow | 239/129 |
| 2,938,672 | 5/1960 | Glatfelter | 239/77 |
| 3,128,036 | 4/1964 | McBride | 239/77 X |
| 3,979,061 | 9/1976 | Kircher | 239/2 S |

*Primary Examiner*—John J. Love

*Attorney, Agent, or Firm*—Richard L. Stevens

[57] ABSTRACT

A snow-making machine which includes a tunnel-like housing, a fan to create an airstream, and nozzles for the formation of ice nuclei and water droplets. The fan is secured within the housing upstream of the nozzles. An inlet screen is secured to the housing upstream of the fan. The screen is heated to prevent the accumulation of ice on the screen. A shield is placed upstream of the fan to prevent the flow of air across the portion of the fan where ice would adhere to the fan.

14 Claims, 4 Drawing Figures

APPARATUS AND METHOD FOR PREVENTING ICING ON A SNOW-MAKING MACHINE

BACKGROUND OF THE INVENTION

Snow-making machines commonly fall into two basic categories: air systems which employ a combination of compressed air and water passing through a single nozzle and so-called airless systems, which do not have a requirement of compressed air or use only relatively small amounts of compressed air to generate ice nuclei.

Surprisingly, the so-called airless systems typically employ fans or propellers to move large masses of ambient air. One problem found with both systems but particularly with the airless systems using the propellers or fans for the large volume movement of air is that a portion of the output of these systems consists of partially frozen snow or water and water spray.

This partially frozen snow or water or water spray, hereinafter collectively referred to as ice particles, even under optimum conditions may eventually fall or are drawn into the housing of a snow-making machine causing icing. The problem of icing is particularly acute when the wind direction changes and the ice particles are blown back toward the snow-making machine. In this circumstance large amounts of ice particles fall in the housing causing icing and more importantly are drawn into the housing by the fan causing icing on the fan to the degree that the machine must eventually be shut down and ice removed before further operation.

This blow back under certain conditions of wind will therefore recirculate through the inlet or upstream portion of the snow-making machine and freeze up on the inlet screen and the fan. This eventually causes blockage of the inlet and shut down of the snow-maker and/or causes destructive unbalance of the fan which is rotating at a high speed.

It is not always possible to operate snow-makers in a manner to prevent this blow back. When a steady wind exists it is often possible to point the machine downwind and eliminate the blow back but as a practical matter it has been found that the winds change, often the wind is gusty and not uniform in direction.

This problem was substantially overcome in U.S. Pat. No. 3,948,442. However, even with the invention of that patent there is still a small percentage of fines which remain suspended in the air and may eventually drift back and fall on or be drawn into the housing. Also, depending on atmospheric conditions, that is, natural precipitation may also result in the presence of ice particles.

Conventional separators to remove ice particles from the air prior to its entry into the housing of a snow-making machine are not suitable. Conventional separators which rely upon large diameters to reduce the pressure of a fluid to precipitate out entrained materials are unwieldy and costly. Also, the precipitated ice would tend to accumulate in the separator requiring costly removal such as with heating elements. This same problem of ice accumulation would also occur with centrifugal separators, mist eliminators, etc.

I have now discovered that the problems of icing particularly on snow-making machines may be eliminated in either one of two ways or by utilizing both ways. Both techniques employed relate to reducing the bond between the ice particles and the protective screen upstream of the fan and/or between the ice particles and the surface of the rotating fan thereby preventing accumulation of the same on either the screen and/or fan.

BRIEF SUMMARY OF THE INVENTION

My invention is broadly directed to an apparatus and method for lessening the bond between adhering particulate matter and the surface to which it adheres which surface is in communication with a fluid stream.

One embodiment of the invention is directed to preventing the accumulation of ice on a screen of a snow-making machine which screen is in fluid flow communication with a fan. The screen is heated with reference to the melting point of the ice. More particularly, the temperature of the screen is controlled such that a piece of ice adhering to the screen will cause the temperature of the screen where the ice is adhering to rise above the freezing point of water. The bond of adhesion or attachment point of the piece of ice is then lessened and loses its strength and the ice is carried in the air stream. Under non-icing conditions the heat imparted to the screen generally is not sufficient to raise the screen surface temperature above freezing because of the high velocity air stream. However, once the ice attaches itself the cooling effect of the air stream is locally insulated by the ice and the interior temperature rises rapidly melting the bond and allowing the ice to fall away. In the preferred embodiment of the present invention the screen is disposed upstream of the fan and secured to a tunnel-like housing.

In another embodiment of the invention a fan inlet design is provided which controls the flow of air stream across the fan. The fan is in an environment wherein the air stream contains particulate matter such as ice particles or certain types of insecticides or similar materials that are sprayed and are present in the ambient. The inlet design insures that the force on the particulate matter due to blade rotation exceeds the strength of the bond between the particulate matter and the blade surface. More particularly, depending on the type of particulate matter encountered the fan is shielded from the air stream such that the only point of contact of particulate matter with the fan is where the radial acceleration on the blade surface will be sufficient to break any adhering bond.

For the purposes of this application the portion of the rotating member or fan where the particulate matter will adhere and the bond will not be broken, will be referred to as the critical radius. Where particulate matter and/or ice strike the member and will be cast off due to the radial acceleration is beyond the limit of the critical radius.

In a preferred embodiment of the invention the fan inlet of an airless snow-making machine is designed with reference to the fan to control the flow of the air stream across the fan. The air stream containing ice particles only contacts the outer portion of the fan. If ice particles adhere to the blade surface they quickly break away, the forces on the adhered particles caused by the blade rotation exceeding the strength of the ice to the fan surface bond.

In the preferred embodiment of the present invention in an airless snow-making machine both a heated screen upstream of the fan and a shield to control the flow of the air stream across the fan are used.

DESCRIPTION OF THE PREFERRED EMBODIMENT

The invention will be described in reference to an airless snow-making machine such as described in U.S. Pat. Nos. 3,703,991; 3,733,029; 3,567,117; and 3,774,842 all of which are incorporated by reference in this application in their entireties. Basically, water droplets and ice nuclei for the formation of snow are separately formed. The nuclei and droplets are subsequently mixed and discharged into an air stream to form snow-like crystals.

Figure 1:
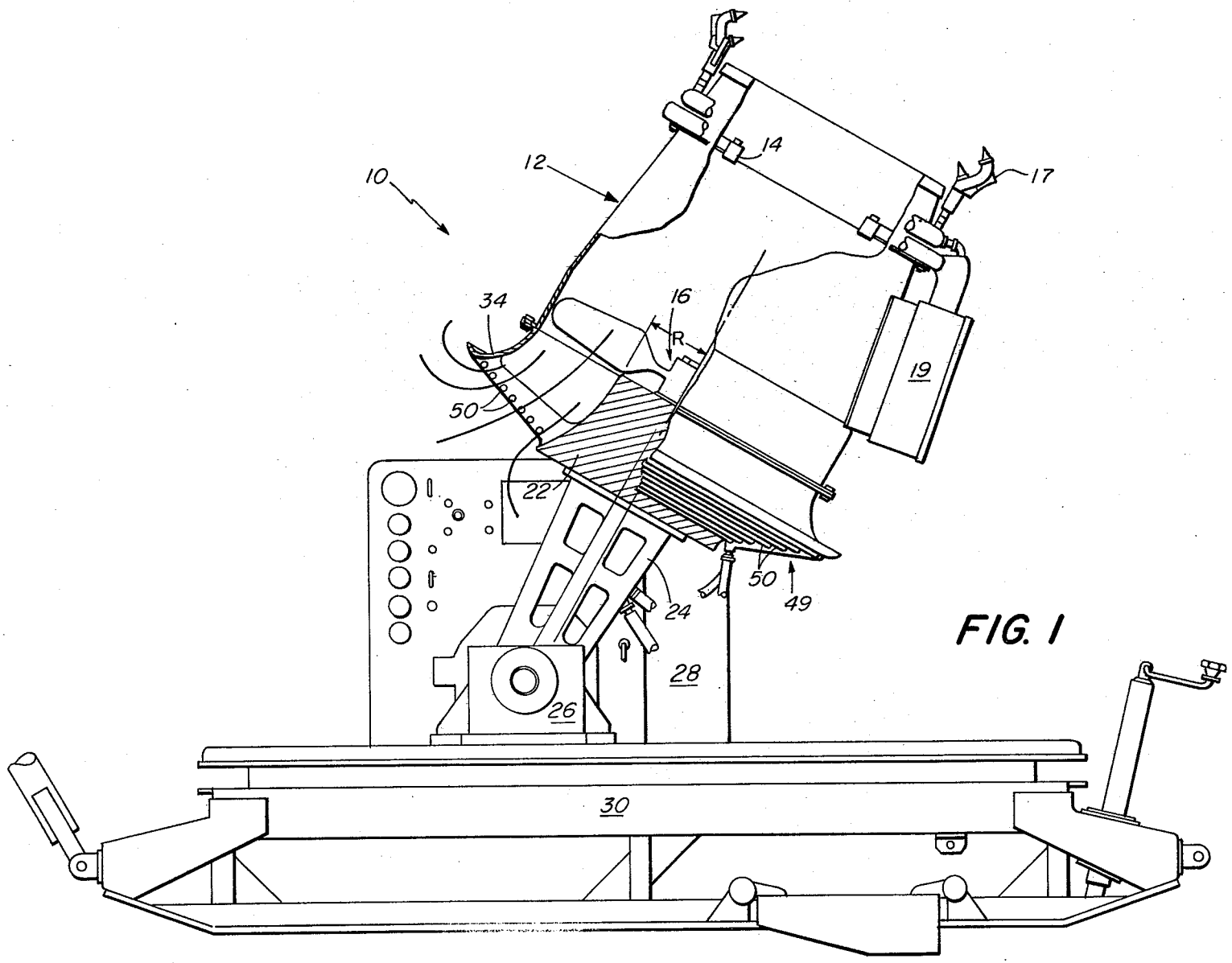
FIG. 1 is a schematic partly broken away view of an airless snow-making machine embodying the concepts of the invention.

Referring to FIG. 1, a snow-making machine 10 is shown having a tunnel-like housing 12 and fan inlet 32, partly broken away. Nucleating nozzles 14 (two shown) to form ice nuclei are secured within the housing downstream of a fan 16. The fan 16 generates the movement of the air stream through the housing 12. The nucleating nozzles 14 are upstream of an array of nozzles 17 for the formation of water droplets. The nuclei generated by the nozzles 14 are mixed with the separately formed water droplets and carried by the air stream created by the fan 16. The nozzles 17 are connected to a manifold 19. The specifics of the formation of the nuclei and water droplets and the subsequent formation of snow with this type of an airless snow-making machine are described in detail in the aforementioned patents.

The fan 16 comprises a hub 18 and a plurality of blades 20 mounted on the hub 18. Adjacent the fan 16 is a shield or fan mount 22 in accordance with one aspect of the invention. A fan support 24 is secured at one end to the fan mount 22 and at the other end to a transmission assembly 26. A power shaft (not shown) extends from the transmission assembly through the fan support to the fan.

The engine to drive the transmission and instrumentation to control the operation of the machine are disposed in a module 28. The transmission assembly 26 and module 28 are secured to a support frame 30. The transmission assembly, power shaft, fan support and fan are conventional and need not be described in detail. In this preferred embodiment of the invention the inlet screen commonly found on such machines and the fan mount 22 upstream of the fan 16 are modified.

Figure 2:
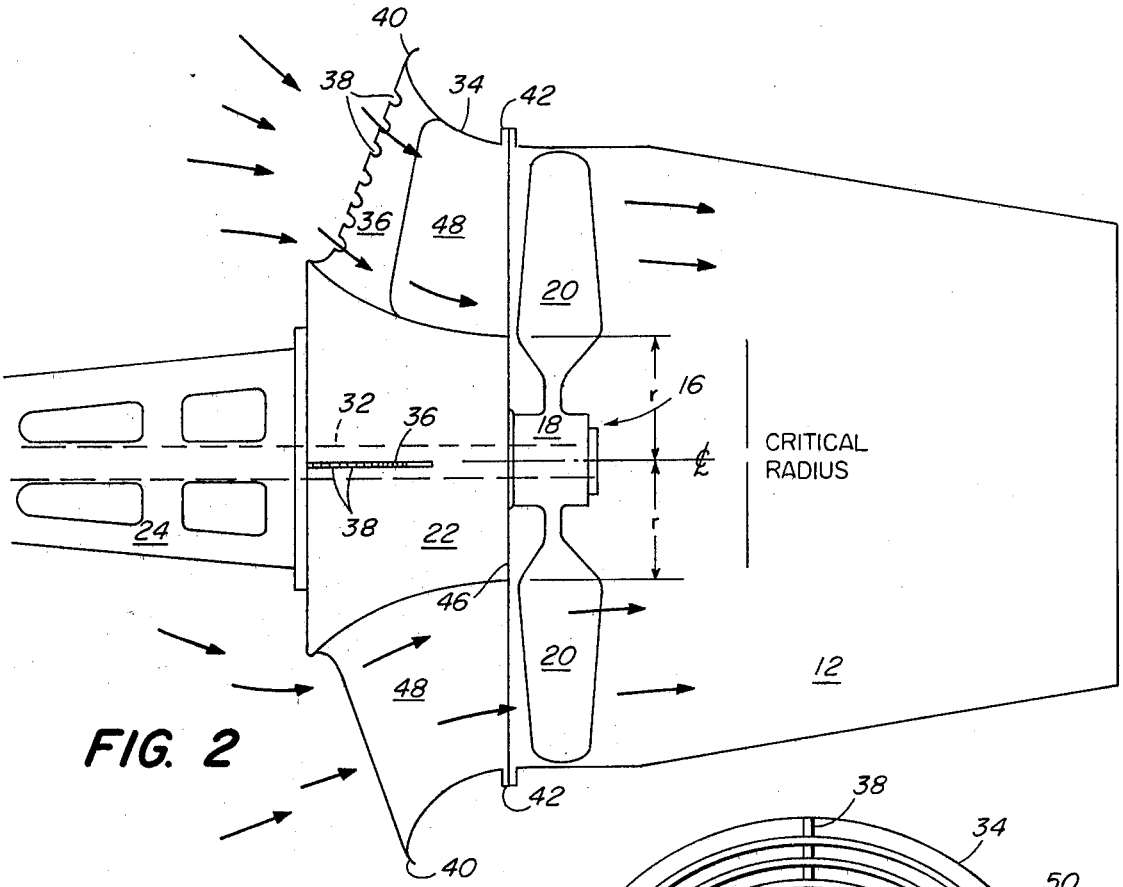
FIG. 2 is a side view of the machine of FIG. 1 illustrating a fan inlet design.

Referring to FIG. 2 the fan 16 is secured to the power shaft, shown in dotted lines, in the customary manner. The fan mount 22 such as of a solid aluminum casting has a center bore 32 through which the power shaft passes in a rotatable manner. The fan 16 is secured to the power shaft in a manner common to the art. The mount is secured such as by welding, to the fan support 24.

An annular inlet 34 is secured to the fan mount 32 by four struts 36, spaced 90° apart, only two of which are shown in FIG. 2 for clarity. Preferably, the inlet 34 and mount 22 are welded to the struts. The leading edges of the struts 36 include a plurality of grooves 38. One end of the inlet 34 is flanged at 40 and the other end 42 of the inlet 34 is flanged and is bolted to a matching flange on the housing 12.

The fan mount 22 has one end 44 secured to fan support 24 and an arcuate outer surface the circumference of which diminishes in cross-sectional area from the end 44 to the other discharge end 46. The fan inlet 34 has an arcuate inner surface opposed to the outer surface of the fan mount. These surfaces define an annular flow passage 48.

The fan mount 22 is designed with reference to the fan 16 to insure that the air stream flowing across the fan 16 and particularly the fan blades 20 does not contact the surfaces in the critical radius where ice could accumulate. The flow of the air stream across the blades 20 is shown by the arrows. The fan 16 in this preferred embodiment is a 33 inches diameter ducted cast aluminum fan having six blades (only two shown). In operation, the fan rotates at about 3100 rpm to provide about 40,000 cubic feet per minute of air flowing through the annular flow passage 48. Such fans are available such as from Joy Manufacturing Company.

When ice particles adhere to the blades 20 they will be cast off because the force (F) acting on the ice particles is greater than the strength of the ice to metal bond.

The main force F on the ice particules caused by fan rotation is:

$$F = W^2 r/g$$

Where W equals annular rate of rotation in radians per second, $r$ equals radians in feet and $g$ equals the acceleration of gravity.

If W is radians per second and $r$ is in feet the units F are feet per second squared which when divided by the acceleration of gravity $g$, yields the radial force in terms of $g$. For the fan 16 described above when $W^2r/g$ is greater than or equal to 1500 $g$'s ice build-up does not occur. The precise limit for the radial acceleration which prevents ice build-up will depend upon fan material (ice to surface bond) and air temperature. The limit of 1500 $g$'s has been found to be sufficient when the snow-making machine 10 is operated for its intended snow-making purpose. Of course, this limit will also vary depending upon fan blade construction. Because the radial force varies linearly as the radius, a completely exposed fan will always have some small radius at which the radial force is insufficient and ice will form within the critical radius. To insure no ice build-up on the fan 16, the fan mount 22 is designed to shield the fan 16 and prevent the flow of air across the fan where the radial force would not be sufficient to cast off ice particles. Stated otherwise the air stream does not flow through the critical radius. The fan 16 is shielded from the air stream out to the critical radius where $W^2r/g$ exceeds the critical value.

In this embodiment selecting a critical value of 1800 $g$'s, W equals $2\pi \times 3100$ and $r = 7/12$ of a foot. Thus, the diameter of the discharge end 46 of the fan mount 22 is about 1.17 feet. The value of 1800 $g$'s over the previous calculated value of 1500 $g$'s is simply an increased margin of safety to insure no ice build-up. As shown in FIG. 2, the fan mount 24 is of sufficient diameter to prevent the flow of the air stream across the blades 20 or hub 18 within the critical radius.

Figure 3:
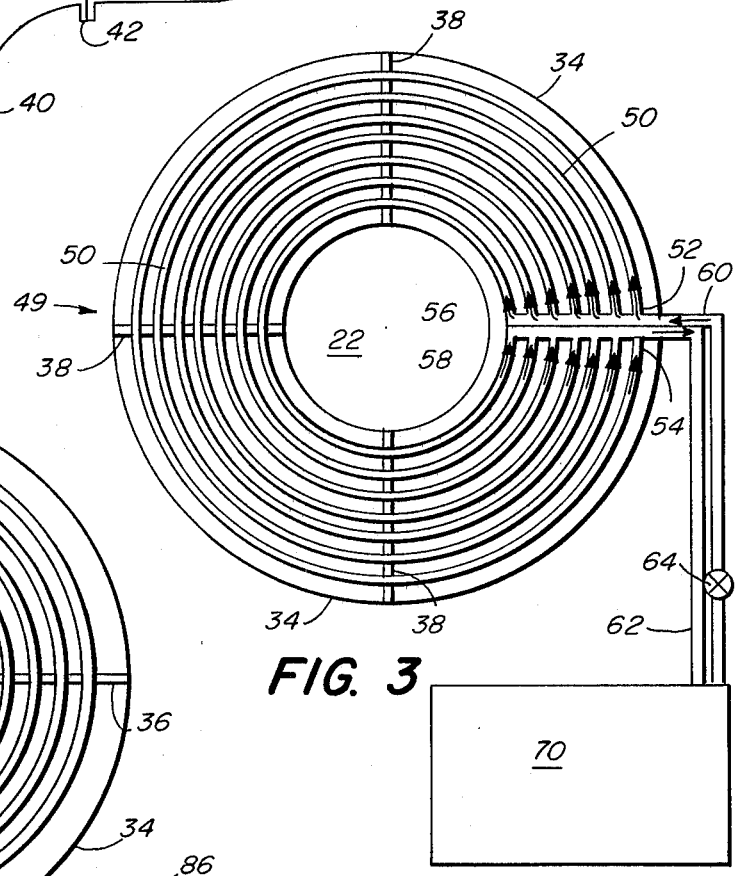
FIG. 3 is a schematic view of FIG. 1 taken along lines 3—3 showing a screen of the preferred embodiment; and, FIG. 4 is an end view of an alternative embodiment of the screen of FIG. 1.

FIG. 3 is an schematic end view of FIG. 1. A heated inlet screen-like manner 49 comprises a plurality of concentric tubes 50 secured to the struts 38. The tubes are formed of suitable heat exchange material such as one-quarter inch outside diameter by 0.020 inch wall SS tubing. Specifically seven concentric rings approximately one inch spacing from outer wall to outer wall are shown. Each of the tubes includes an inlet end and an outlet end 52 and 54, respectively. The ends 52 are sealingly secured to a header 56 and the ends 54 are sealing secured to a header 58. A heat exchange fluid is introduced into the header 56 through a conduit 60 and discharges from the header 58 through a conduit 62. The flow of the heat exchange fluid is controlled by the valve 64. The heat exchange fluid is derived from the engine used to operate the snow-making machine 10. Specifically, the coolant used is from an 80 horsepower 140 cubic inch Chevrolet 4 cylinder inline gasoline engine shown schematically at 70. The coolant from this engine is bypassed and flows through the concentric tubes 50 and returns to the cooling system of the engine. The inlet line 60 is secured to the coolant discharge nipple on the engine block, and the outlet line 62 is secured to the inlet nipple on the engine block. Alternatively, any suitable heat exchange fluid may be pumped through the concentric tubes. The tubes 50 are secured by placing them in the grooves 38 of three of the struts 36 and then staking over the tubes. The bottom of the headers include 7 tube-like projections (not shown) which are received in frictional engagement in the grooves 38 of the associated strut 36.

Figure 4:
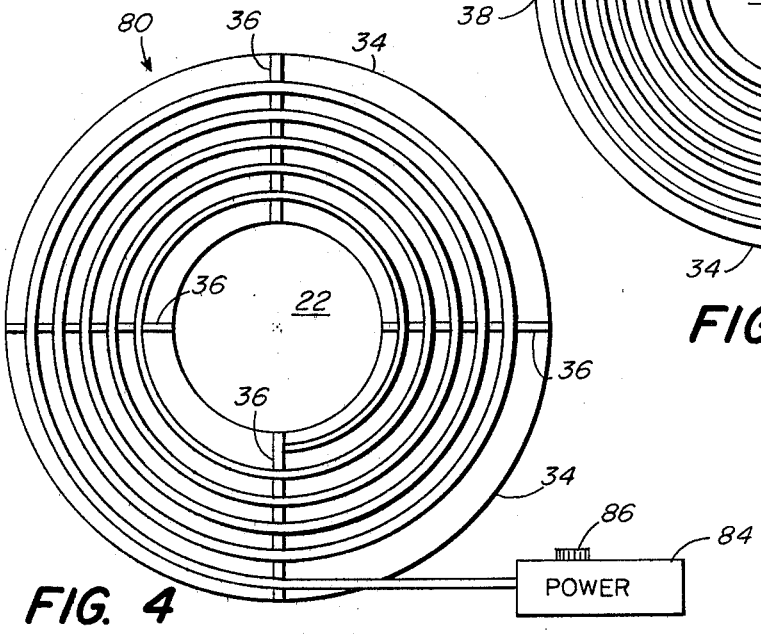

In FIG. 4 a schematic alternative of the heated inlet screen-like member 49 of FIG. 1 is shown at 80. This member 80 comprises heating elements such as No. 10 stainless wire arranged in a three-fold helix 82. The helices are held in place by being secured to grooves in struts 36 such as the tubes 50 in the preferred embodiment were secured. A three-phase alternating current is applied to each of the three legs of the helix 82 from a power supply 84 having a rheostat 86 or other suitable control. In one embodiment a voltage of 20 volts and a current of approximately 20 amps per leg was found sufficient to prevent icing. Also, such a voltage is low enough to be safe against injurious electrical shock to human beings.

In the operation of the snow-making machine 10 the appropriate valves, etc. are opened and power provided for the discharge of ice nuclei from the nozzles 14 and water droplets from the nozzles 17. The fan 16 is actuated to create an air stream which passes through the inlet 34 and the housing 12. Typically, the machine 10 is operated at a temperature below 32° F, preferably in a temperature range between about 5° to 30° F. The ice nuclei and water droplets are mixed and entrained in the air stream and ultimately form snow-like particles.

Referring to FIG. 3, the valve 64 is opened to allow for the flow of the heat exchange fluid through the concentric tubes 50. During the operation of the snow-making machine 10, if it appears that ice is building-up or accumulating on any portion of the inlet screen 49, the valve 64 can be adjusted to allow for more heat exchange fluid to flow through the tubes 50 until such time as the ice does not accumulate. In fact, if icing conditions exist a preferred method of operation is to turn down the valve until ice begins to accumulate and then open it slightly to prevent the ice accumulation. In this way, ice will not accumulate and excess heat will not be input into the air stream.

The heat exchange fluid flows through the conduit 60 at a rate of 0.5 to 5.0 gal./min. at a temperature of between about 140° F. to 220° F. When making the adjustment as described above, when ice adheres to the surface of the tubes 50, the area of contact is locally insulated. The temperature rises melting the bond and the ice breaks away. This area and temperature of the surface of the tubes is not sufficient to raise the temperature of the air stream above freezing.

Alternatively, if an electrical screen is used such as shown in FIG. 5 the rheostat is varied to control the amount of current flowing through the legs of the helices or heating elements in the manner as described above.

The fan mount 24 prevents the air stream from contacting the fan 16 at any point within the critical radius. Thus, if any ice particles do contact and adhere to the fan 16 they will be cast off.

Although two specific types of heated inlet screens have been disclosed namely, a plurality of concentric rings adapted to receive a heat exchange fluid and a wound helix through which current passes various other combinations will be apparent to those skilled in the art. For example, a grid-like configuration could be used having either electrically heated elements or tubes through which a heat exchange fluid passes. Also, it is possible to have a combination of both tubes for a heat exchange fluid and elements for the application of electrical current. Further, the tubes themselves may also be electrically heated in addition to containing a heat exchange fluid. The only constraint on any such configuration regardless of its geometric arrangement whether it be helices concentric rings, grids, diagonal arrangements or any combination thereof is that the apertures defined be large enough not to inhibit seriously the flow of the air stream and be small enough such that appropriate safety regulations in regard to rotating members are not violated. For the above described embodiments the one inch spacing has been found to provide no problem in either regard.

The fan inlet design has been described as a shield having a diminishing cross-sectional area to a discharge end. The design of the fan mount or shield may assume any configuration as long as the air stream is baffled away from the critical radius of the fan or propeller. For example, the fan input may simply be cylindrical, cone shaped, atuncated cone, etc. Also, the critical radius will vary depending upon fan blade design, type of material and speed of rotation.

Having described my invention what I now claim is:

1. A method of making snow at a temperature less than 32° F wherein ice nuclei and water droplets are formed and a rotating member creates an air stream which entrains and mixes the ice nuclei and water droplets whereby they eventually form snow-like crystals and when the ambient within which the snow-making machine is operated contains ice particles which will adhere to the surface of the rotating member which creates the air stream when the radial force acting on the particle is not sufficient to break the bond between the adhered particles and the surface of the rotating member which includes:

creating an air stream with a rotating member;

forming ice nuclei and water droplets;

entraining the ice nuclei and water droplets in the air stream whereby the ice nuclei and water droplets eventually form snow-like crystals; and, controlling the flow of the air stream across the rotating member such that the air stream does not contact the surface of the rotating member where the radial force is not sufficient to break the bond between the particles and the surface of the rotating member.

2. The method of claim 1 which includes:
controlling the flow of the air stream to shield the rotating member from the center of rotation outwardly to a predetermined radius beyond which radius particles contacting the member will be cast off.

3. The method of claim 1 which includes:
forming the ice nuclei in a first zone;
forming the water droplets in a second zone distinct from the first zone;
mixing the ice nuclei and water droplets in a third zone distinct from the first and second zones.

4. The method of claim 3 which includes:
flowing the air stream through a tunnel-like housing.

5. The method of claim 1 which includes flowing the air stream through an annular flow passage upstream of the rotating member.

6. The method of claim 1 wherein a screen-like member is disposed upstream of the rotating member and which includes:
placing the air stream in a heat-exchange relationship with the screen-like member; and
controlling the temperature of the surface of the heat exchange member such that when an ice particle adheres to the surface the temperature at the point of adhesion is sufficient to break the bond between the ice particle and the surface.

7. The method of claim 6 which includes:
forming the ice nuclei in a first zone;
forming the water droplets in a second zone distinct from the first zone; and
mixing the ice nuclei and water droplets in a third zone distinct from the first and second zones.

8. A snow-making machine which comprises:
a rotating member to generate an air stream;
means to provide ice nuclei and water droplets in communication with the air stream the nuclei and the droplets becoming commingled and entrained in the air stream and forming snow-like crystals; and,
means to control the flow of the air stream across the rotating member disposed adjacent the rotating member said means dimensioned to prevent the flow of the air stream across the surface of the rotating member and within a critical radius where the radial force of the member acting on an adhered ice particle is less than the strength of the bond between the ice particle and said surface whereby when the ambient within which the snow-making machine is operated contains ice particles the particles will not accumulate on the rotating member.

9. The machine of claim 8 wherein the means to control the flow of the air stream is secured adjacent to and upstream of the rotating member.

10. The machine of claim 8 which includes a tunnel-like housing and the rotating member is secured to the housing upstream of the means to provide ice nuclei and water droplets.

11. The machine of claim 10 wherein the rotating member is a fan and the means to control the flow of the air stream is a fan mount; and which includes means to form the ice nuclei and water droplets in separate zones.

12. The machine of claim 11 wherein the fan mount and the housing define an annular flow passage.

13. The machine of claim 8 which includes a screen-like member upstream of the rotary member; and,
means to heat the screen-like member to prevent the accumulation of ice thereon.

14. The machine of claim 13 wherein the rotating member is a fan and the means to control the flow of the air stream is a fan mount and which includes:
means to form the ice nuclei in a first zone;
means to form water droplets in a second zone whereby the droplets and ice nuclei are commingled in a third zone distinct from the first and second zones.

* * * * *